US007625225B2

(12) United States Patent
Mori et al.

(10) Patent No.: US 7,625,225 B2
(45) Date of Patent: Dec. 1, 2009

(54) LEVER-TYPE CONNECTOR

(75) Inventors: Shigeo Mori, Shizuoka-ken (JP); Teruhiko Ohike, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/251,940

(22) Filed: Oct. 15, 2008

(65) Prior Publication Data

US 2009/0117764 A1 May 7, 2009

(30) Foreign Application Priority Data

Nov. 5, 2007 (JP) ..... 2007-287049

(51) Int. Cl.
*H01R 13/62* (2006.01)

(52) U.S. Cl. ..... 439/157

(58) Field of Classification Search ..... 439/157–160
See application file for complete search history.

(56) References Cited

U.S. PATENT DOCUMENTS 5,672,068 A * 9/1997 Tsuchiya et al. ..... 439/157
6,793,522 B2 * 9/2004 Yamashita ..... 439/157
2003/0224639 A1 * 12/2003 Yano et al. ..... 439/157
2007/0099461 A1 * 5/2007 Pittenger et al. ..... 439/157

FOREIGN PATENT DOCUMENTS

JP 2002-343169 11/2002

* cited by examiner

*Primary Examiner*—Briggitte R Hammond
(74) *Attorney, Agent, or Firm*—Finnegan, Henderson, Farabow, Garrett & Dunner, L.L.P.

(57) ABSTRACT

A lever is attached to a connector housing in a rotatable manner. This lever includes a pair of arm plates having rotation supporting points at one ends and a connection bar linking the other ends of the arm plates. This lever has a substantially U-like shape. According to this lever, when one ends of the pair of arm plates are opened to the outer sides, the rotation supporting point of the lever is attached, in a rotatable manner, to a rotation supporting pivot of the outer face of the connector housing. By this structure, the lever is rotated for operation to realize a cam action to assist the connectors to be fitted to each other and to be disengaged from one another. According to this lever-type connector, the lever is attached to the connector housing, and subsequently the connection between the arm plates at a position closer to the rotation supporting point of the lever than to the connection bar is provided as a link member linking the arm plates. The movable element of the fitting sensing switch constitutes this link member.

3 Claims, 6 Drawing Sheets

LEVER-TYPE CONNECTOR

BACKGROUND OF THE INVENTION

1. Field of the Invention

The present invention relates to a lever-type connector used as a power supply circuit shutoff apparatus for example.

2. Description of the Related Art

A lever-type connector as disclosed in Patent Publication 1 has been known as a power supply circuit shutoff apparatus provided in an electric vehicle or the like.

This lever-type connector is structured to rotatably attach a lever to one connector housing of a pair of connector housings fitted to each other. By rotating this lever for operation, an action by a cam mechanism provided between the lever and the other connector housing assists these connector housings to be fitted to each other and to be disengaged from each other.

FIG. 1 shows the structure of the movable side of the similar lever-type connector. A lever 110 includes: a pair of left and right arm plates 111; a grooved engagement hole 113 that is provided at one end of the pair of left and right arm plates 111 and that functions as a rotation supporting point; a connection bar 112 that is provided at the other end of the arm plates 111 and that connects the arm plates 111 to each other; a joint section 150 that is provided in the vicinity of the engagement hole 113 functioning as the rotation supporting point and that is provided to secure the rigidity of the arm plates 111; and a cam groove 114 that is provided at the periphery of the engagement hole 113 and that is engaged with the cam pin of the other connector housing.

When the lever 110 having the structure as described above is attached to a connector housing 120, the arm plates 111 are opened while one ends thereof being deflected to the outer sides. As a result, an engagement pin (rotation supporting pivot) 123 provided at the outer face of the connector housing 120 in a protruded manner is fitted into the engagement hole 113 of the arm plates 111.

[Patent Publication 1] Japanese Patent Laid-Open Publication No, 2002-343169

SUMMARY OF THE INVENTION

By the way, the conventional lever-type connector is structured as described above so that the arm plates 111 are opened while one ends of the arm plates 111 being deflected to the outer sides to fit the engagement pin 123 of the connector housing 120 into the engagement hole 113 of the arm plates 111. In this case, the above-described lever 110 causes the arm plates 111 to be deflected to the outer sides so that the deflection of the arm plates 111 is started from supporting points at which the joint section 150 is connected to the arm plates 111. However, the lever 110 having a smaller size in particular causes a reduced distance from the rotation supporting point (the engagement hole 113) to the joint section 150. This means that an increased load is required to deflect the arm plates 111 to attach the arm plates 111 to the connector housing 120. This makes it difficult to attach the lever to the connector housing, which may cause a breakage of the lever 110.

In view of the above circumstances, it is an objective of the present invention to provide a lever-type connector by which even a lever having a smaller size can be easily attached to a connector housing with a smaller force to remove the causing factor of the broken lever.

In according to the first aspect of the invention, a lever-type connector comprises first and second connector housings fitted to each other, a lever including a pair of arm plates having rotation supporting points at one ends respectively and a connection bar linking the other ends of the pair of arm plates, which constructed to a substantially U-like shape, and a link member linking the arm plates of the lever. One ends of the pair of arm plates can be attached, in a rotatable manner, to the rotation supporting point thereof to a rotation supporting pivot provided at an outer face of the first connector housing, respectively, by opening the one ends of the pair of arm plates to the outer sides. An action by a cam mechanism provided between the lever and the second connector housing assists the connector housings to be fitted to each other and to be disengaged from one another by rotating the lever for operation.

After the lever is attached to the first connector housing, the link member is attached between the arm plates at a position closer to the rotation supporting point than to the connection bar.

As described above, at a stage at which the lever is attached to the first connector housing, the link member is not attached to a position close to the rotation supporting point between the arm plates. Thus, the arm plates are easily deflected by a small force to the outer sides with the connection bar away from the rotation supporting point as a supporting point. As a result, the rotation supporting point of the arm plate-side is fitted to the rotation supporting pivot at the outer face of the first connector housing. Thus, even when the lever has a smaller size, the lever can be assembled easily. This prevents the lever from being broken due to the arm plates outwardly opened with an excessively-high force. The link member is attached between the arm plates after the lever is attached to the first connector housing. The arm plates are linked in the final assembled condition at a position close to the rotation supporting point. This prevents the arm plates from being opened, thus improving the rigidity of a part of the lever close to the rotation supporting point. Thus, the lever can be prevented from being unnecessarily deformed when the first connector housing and the second connector housing are fitted to each other by the rotation of the lever. This allows a pair of the connector housings to be securely fitted to each other by a smooth lever operation.

Furthermore, power terminals constituting a power switch are provided to the connector housings, respectively. Fitting sensing terminals constituting a fitting sensing switch are provided to the lever and the second connector housing, respectively. The power terminals and the fitting sensing terminals are configured as a lever fitting-type power supply circuit shutoff apparatus in which: the power switch is turned on when the connector housings are correctly fitted to each other, and the fitting sensing switch is turned on when the fitting sensing terminal are subsequently abutted to each other, and a power supply circuit is caused to be in a conduction state when the fitting sensing switch is turned on; the movable element of the fitting sensing switch accommodates therein the fitting sensing terminal and is attached as the link member between the pair of arm plates of the lever.

As described above, the movable element of the fitting sensing switch of the lever fitting-type power supply circuit shutoff apparatus is provided as the link member connecting the pair of arm plates of the lever. This eliminates the need to provide the movable element of the fitting sensing switch at any other spaces. Thus, the lever can have a more compact configuration.

Furthermore, the movable element of the fitting sensing switch is slidably provided via rails engaged to each other to the lever. A lock mechanism and a lock cancelling mechanism are provided to the lever and the second connector housing. The lock mechanism and the lock cancelling mechanism allow the movable element to be locked at a fixed position while the lever is being rotated from a fitting initial position to a fitting end position. When the lever is rotated and reaches the fitting end position, the lock of the movable element to the fixed position is cancelled and the movable element is allowed to slide and is fitted to the fixed side of the fitting sensing switch provided at the second connector housing. A fitting sensing switch lock mechanism is provided to the second connector housing and the movable element of the fitting sensing switch to allow, when the movable element is fitted to the fixed side of the fitting sensing switch, the movable element to be locked in this condition.

As described above, the movable element provided as the link member is provided in a slidable manner. The movable element can be fitted to the fixed side of the fitting sensing switch only when the connector housings are appropriately fitted to each other. This prevents a risk of a wrong operation and the power supply circuit can be provided in a conduction state only when a fixed procedure is completed securely.

Figure 1:
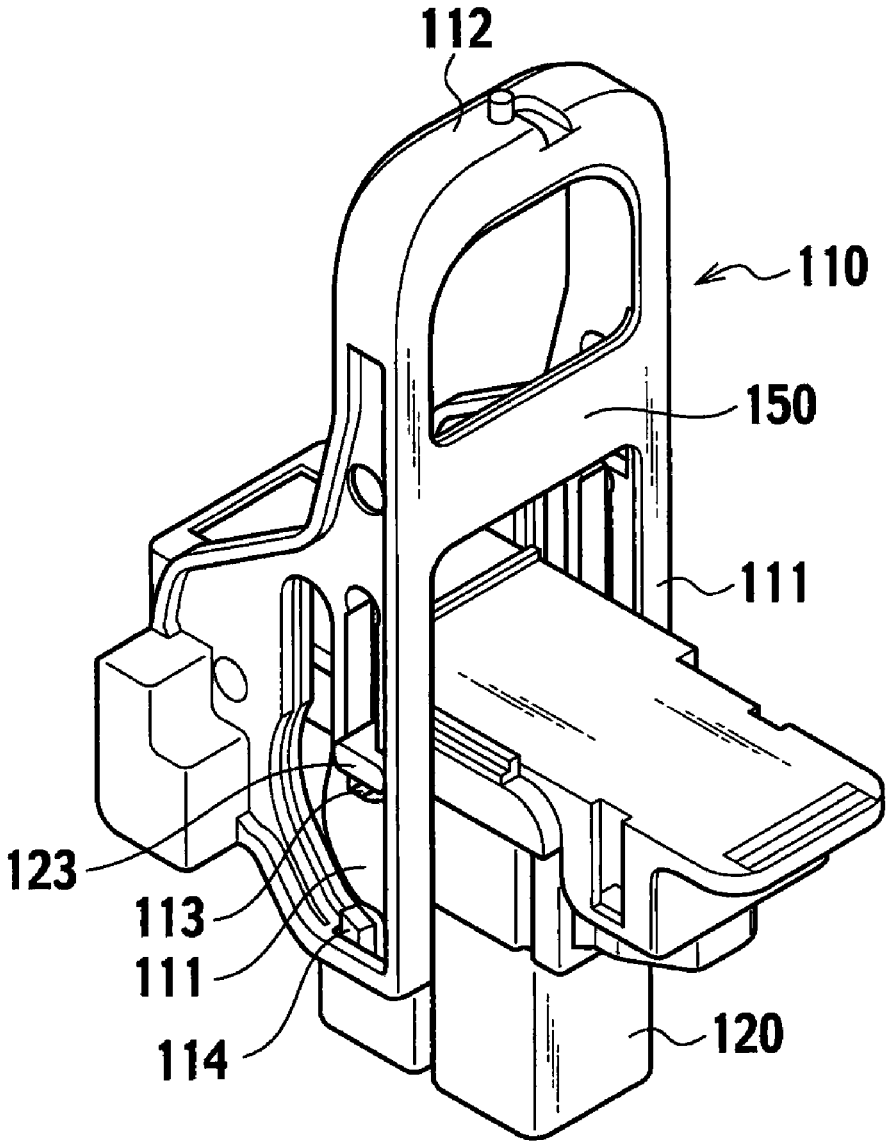
FIG. 1 PRIOR ART
FIG. 1 is a perspective view illustrating a configuration of the movable side of a conventional lever-type connector.

The connector housing 50 of the fixed side is structured so that a main connector housing 52 and the fixed-side housing 53 for the fitting sensing switch are provided on a base plate 51. A pair of fixed side power terminals 57 constituting a power switch is provided in the main connector housing 52. A pair of fitting sensing terminals 58 constituting the fitting sensing switch is provided in the fixed-side housing 53 for the fitting sensing switch. A pair of engagement pins 55 is provided at both outer side faces of the main connector housing 52.

Figure 2:
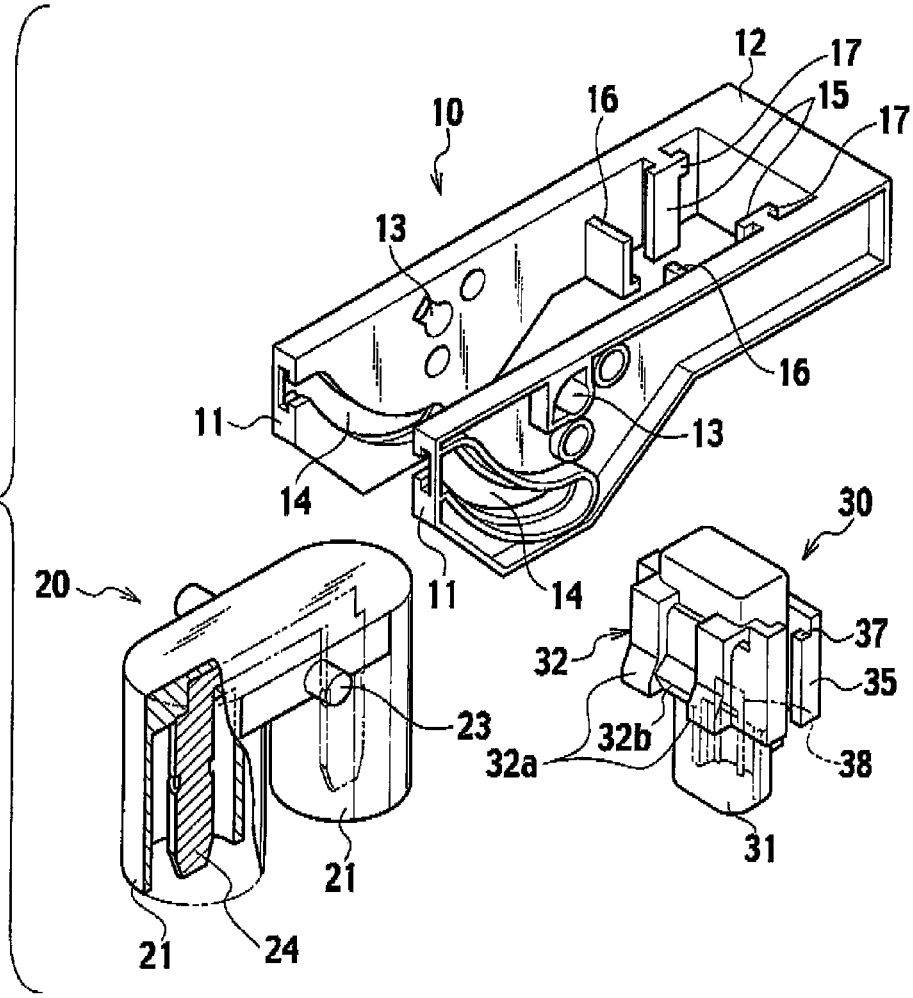
FIG. 2 is an exploded perspective view illustrating the constituting elements of the movable side of the lever-type connector of an embodiment of the present invention used as a power supply circuit shutoff apparatus.

As shown in FIG. 2, the connector housing 20 of the movable side has a fitting section 21 fitted to the main connector housing 52 of the fixed-side connector housing 50 (see FIG. 4) and has a pair of rotation pins (rotation supporting pivot) 23 provided at both outer faces in a protruded manner. A short terminal 24 is provided in the connector housing 20. This short terminal 24 is abutted to the pair of fixed side power terminals 57 to provide conduction between the pair of fixed-sided power terminals 57.

DESCRIPTION OF THE PREFERRED EMBODIMENTS

Hereinafter, embodiments of the present invention will be described with reference to the drawings.

Figure 4:
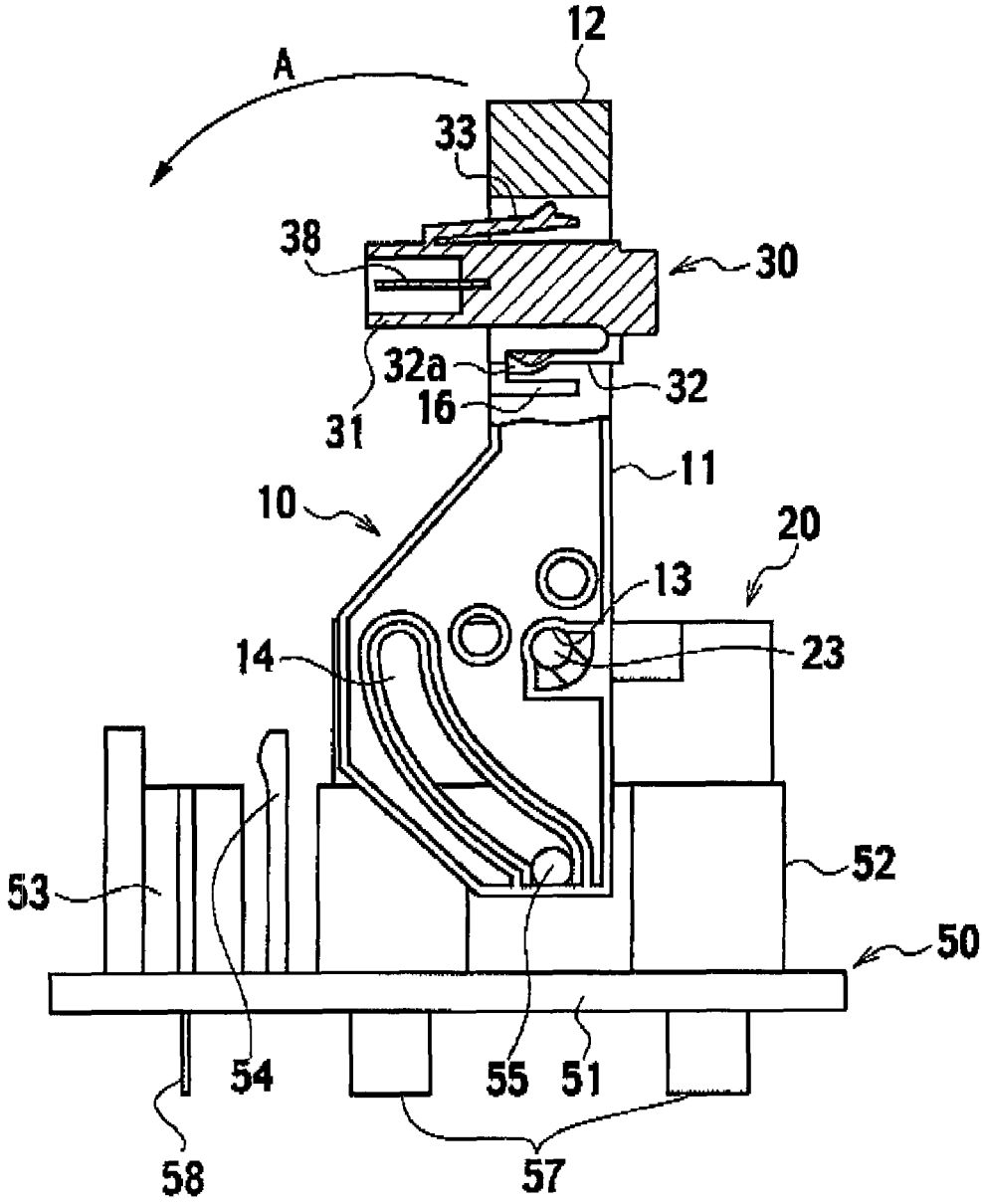
FIG. 4 is a partial broken side view illustrating an initial connector fitting condition combining the movable side with the fixed side.

This lever-type connector is configured as a power supply circuit shutoff apparatus. This lever-type connector includes, as shown in FIG. 4, a pair of connector housings 50 and 20 at the fixed side and the movable side that are both made of synthetic resin and that are fitted to each other; a lever 10 attached to the connector housing 20 of the movable side in an arrow A direction in a rotatable manner; and a movable element 30 of a fitting sensing switch that is attached to the lever 10 after the lever 10 is attached to the connector housing 20.

The connector housing 50 of the fixed side is structured so that a main connector housing 52 and the fixed-side housing 53 for the fitting sensing switch are provided on a base plate 51. A pair of fixed side power terminals (not shown) constituting a power switch is provided in the main connector housing 52. A pair of fitting sensing terminals (not shown) constituting the fitting sensing switch is provided in the fixed-side housing 53 for the fitting sensing switch. A pair of engagement pins 55 is provided at both outer side faces of the main connector housing 52.

As shown in FIG. 2, the connector housing 20 of the movable side has a fitting section 21 fitted to the main connector housing 52 of the fixed-side connector housing 50 (see FIG. 4) and has a pair of rotation pins (rotation supporting pivot) 23 provided at both outer faces in a protruded manner. A short terminal (not shown power terminal) is provided in the connector housing 20. This short terminal is abutted to the pair of fixed side power terminals to provide conduction between the pair of fixed-side power terminals.

The lever 10 includes: the pair of arm plates 11 that have engagement holes 13 functioning as a rotation supporting point at the respective ends; and a connection bar 12 connecting the other ends of the pair of arm plates 11 to each other. The lever 10 has a substantially U-like shape. By opening the pair of arm plates 11 by deflecting the one ends thereof to the outer sides, the engagement hole (rotation supporting point) 13 of the arm plate is attached, in a rotatable manner, to the rotation pin (rotation supporting pivot) 23 provided at the outer side face of the movable-side connector housing 20.

The arm plate 11 has a cam groove 14 at the periphery of an engagement hole 13. The arm plate 11 also has a slide rail 15 and a stopper 16 at an inner face between the engagement hole 13 and the connection bar 12.

The cam groove 14 is formed to have a curved shape along which the distance from the engagement hole 13 gradually changes. The cam groove 14 is engaged with an engagement pin 55 of the fixed-side connector housing 50. As a result, the lever 10 is rotated for operation so that the cam groove 14 and the engagement pin 55 cause the fixed-side connector housing 50 and the movable-side connector housing 20 to move to each other or away from each other. In this manner, a cam mechanism is configured that assists the connector housings 50 and 20 to be fitted to each other or to be disengaged from each other.

The slide rail 15 is provided at a position closer to the engagement hole 13 functioning as a rotation supporting point than the connection bar 12. After the lever 10 is attached to the connector housing 20, the movable element 30 of the fitting sensing switch is attached to the slide rail 15. The movable element 30 has a fitting section 31 fitted to the fixed-side housing 53 for the fitting sensing switch (see FIG. 4). A short terminal (fitting sensing terminal) 38 is housed in the fitting section 31. This short terminal 38 is abutted to the pair of fitting sensing terminals 58 housed in the fixed-side housing 3 of the fitting sensing switch (see FIG. 4) to be conductive with the pair of fitting sensing terminals 58.

The movable element 30 has engagement rails 35 at both side faces thereof. The engagement rails 35 are engaged with the slide rails 15 at the inner faces of the arm plates 11. Thus, the movable element 30 functions as a link member that links the arm plates 11. The movable element 30 has the first lock arm 32 and the second lock arm 33 at other side faces.

Figure 3:
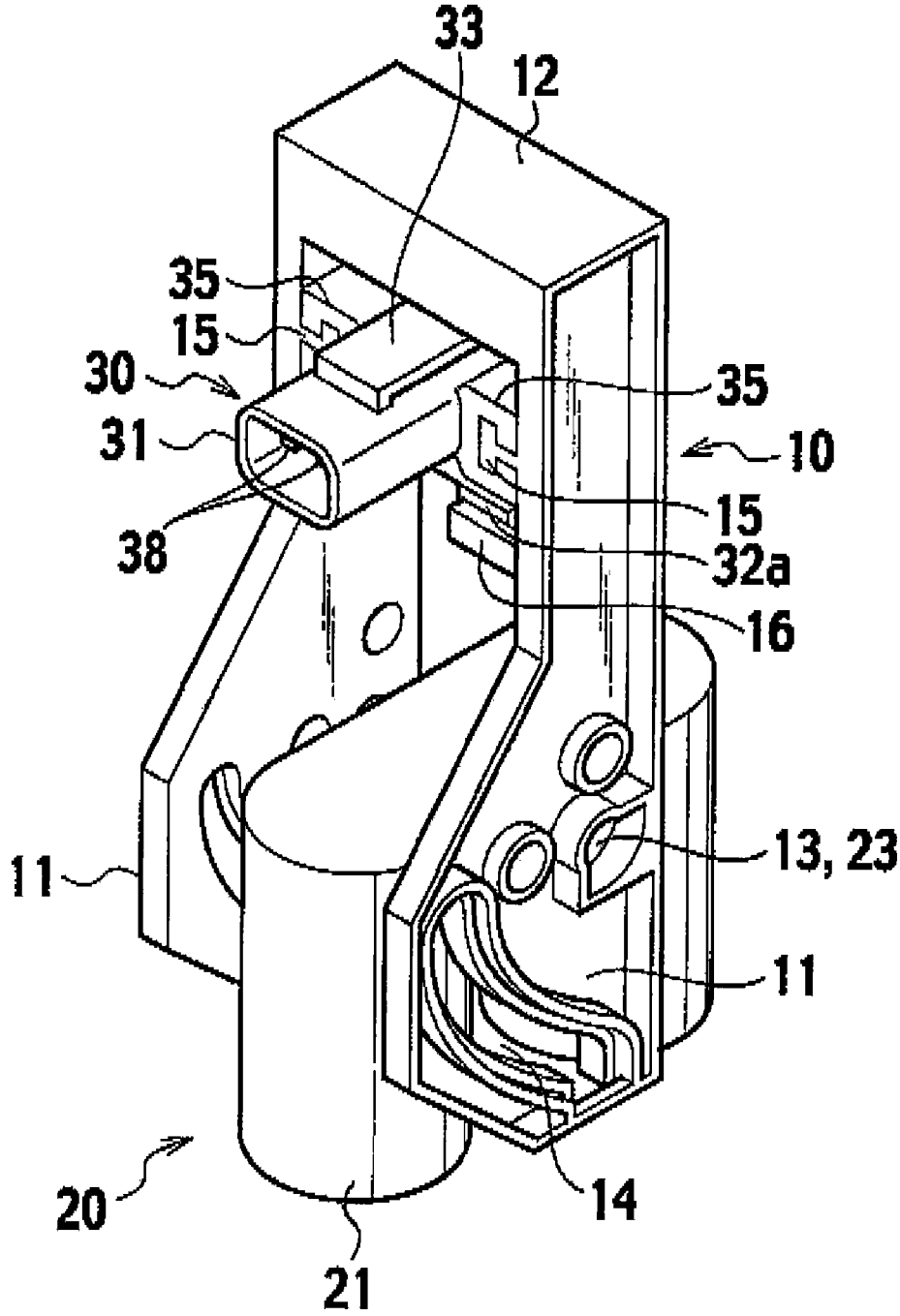
FIG. 3 is a perspective view illustrating the configuration of the movable side in an assembled condition.

This movable element 30 is attached from one end of the slide rail 15. Then, as shown in FIG. 2 and FIG. 3, a lock section 32*a* of the first lock arm 32 extends over the stopper 16 and the second stopper 17 is abutted to a stopper abutting face 37 to be retained at a fixed position.

A lock cancelling arm 54 is provided to the fixed-side connector housing 50. When the lever 10 is rotated to an end position for operation, the lock cancelling arm 54 is abutted to a lock cancelling section 32*b* of the first lock arm 32. Then, the first lock arm 32 is deflected to the inner side. As a result, the abutment (lock) of the lock section 32*a* to the stopper 16 is cancelled. Thus, the lock section 32*a* of the first lock arm 32 and the stopper 16 constitute the lock mechanism. The lock cancelling section 32*b* of the first lock arm 32 and the lock cancelling arm 54 constitute the lock cancelling mechanism.

When the abutment of the first lock arm 32 to the stopper 16 is cancelled, the movable element 30 can be slid to the other end of the slide rail 15. A latch section 56 is provided to the fixed-side connector housing 50. When the fixed-side housing 53 of the fitting sensing switch is fitted to the fitting section 31 of the movable element 30, the latch section 56 latches the second lock arm 33 of the movable element 30-side to lock the movable element 30 to prevent the movable element 30 from being disengaged. In this manner, the second lock arm 33 of the movable element 30-side and the latch section 56 of the fixed-side connector housing 50 constitute the fitting sensing switch lock mechanism.

Figure 7:
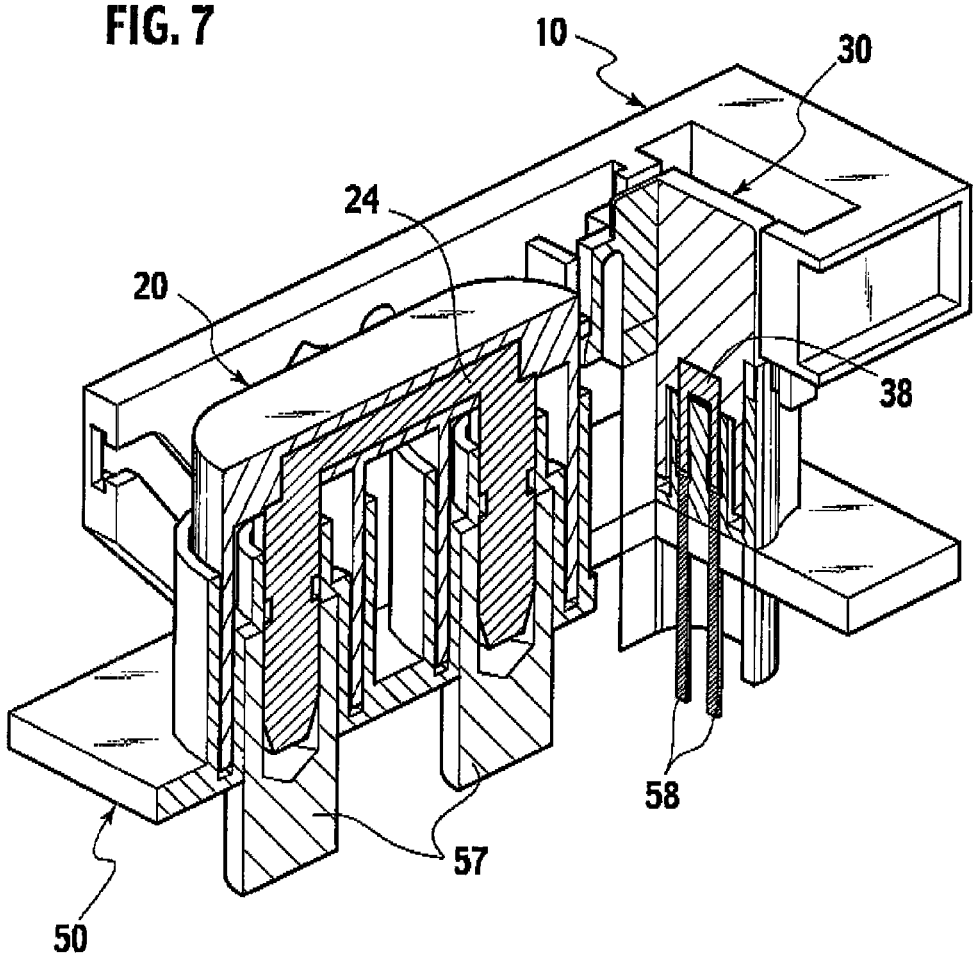
FIG. 7 is a partial broken perspective view illustrating a fitting-completed condition in which a movable element of a fitting sensing switch is fitted to the fixed side from the condition where the connector housings are fitted to each other.
Figure 8:
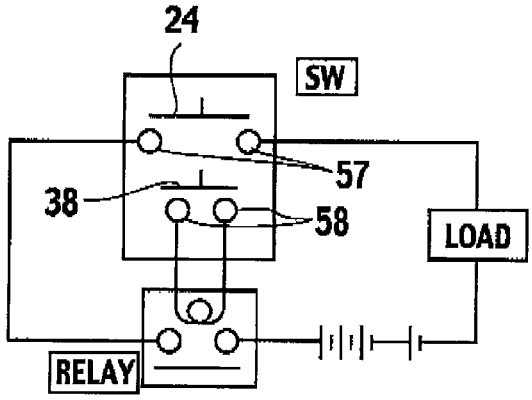
FIG. 8 is an a example of a power supply circuit in which the lever-type connector is used by being connected into the power supply circuit.

This lever-type connector is configured as a power supply circuit shutoff apparatus. Thus, the power switch is turned on when the connector housings 20 and 50 are correctly fitted to each other. When the movable element 30 and the fixed-side housing 31 are subsequently fitted to each other to abut the fitting sensing terminals 58 and 38 to each other, the fitting sensing switch is turned on. When the fitting sensing switch is turned on, a power supply circuit (as shown in FIG. 7, for example) is in a conduction state. In this manner, the lever-type connector is used by being connected into the power supply circuit.

Next, the operation will be described.

In order to assemble this lever-type connector, the lever 10 is firstly attached to the connector housing 20 shown in FIG. 2. Specifically, while the movable element 30 of the fitting sensing switch is not being attached to the lever 10, the lever 10 is opened to the outer side by deflecting the pair of left and right arm plates 11. Then, the engagement holes 13 of the lever 10 in this condition are fitted to a rotation pins 23 of the connector housing 20.

At a stage at which the lever 10 is attached to the connector housing 20 as described above, the movable element 30 functioning as the link member is not attached to a position close to the engagement holes 13 between the arm plates 11. Thus, the arm plates 11 can be outwardly deflected by a smaller force with the connection bar 12 away from the engagement holes 13 by using the connection bar 12 as a supporting point. As a result, the engagement holes 13 of the arm plate 11-side are fitted to the rotation pins 23 at the outer face of the connector housing 20.

Thus, even when the lever 10 has a smaller size, the lever 10 can be attached easily. This prevents the lever from being broken due to the arm plates outwardly opened with an excessively-high force.

Thus, as described later, the lever 10 can be prevented from being unnecessarily deformed when the connector housings 20 and 50 are fitted to each other by the rotation of the lever 10. This allows the connector housings 20 and 50 to be securely fitted to each other by a smooth lever operation.

After the lever 10 is attached to the connector housing 20, the movable element 30 is attached between the arm plates 11. Specifically, the engagement rails 35 of the movable element 30 are slid and are engaged with the slide rails 15 of the arm plates 11 from one end (lower side). As a result, the movable element 30 provides a mechanical link between the arm plates 11, thus preventing the arm plates 11 from being opened. Thus, a part closer to the engagement hole 13 of the lever 10 has improved rigidity.

When the movable element 30 is attached to the slide rails 15 as described above, the lock section 32*a* of the first lock arm 32 of the movable element 30 is abutted to the stopper 16. This allows the movable element 30 to be retained as a fixed position.

In this condition, as shown in FIG. 4, the movable-side connector housing 20 attached with the lever 10 and the movable element 30 are assembled with the fixed-side connector housing 50. In this case, the fitting section 21 of the movable-side connector housing 20 firstly enters an inlet of a main connector housing 52 of the fixed-side connector housing 50. Then, the engagement pin 55 is inserted to the inlet of the cam groove 14 of the lever 10 that is raised vertically.

Figure 5:
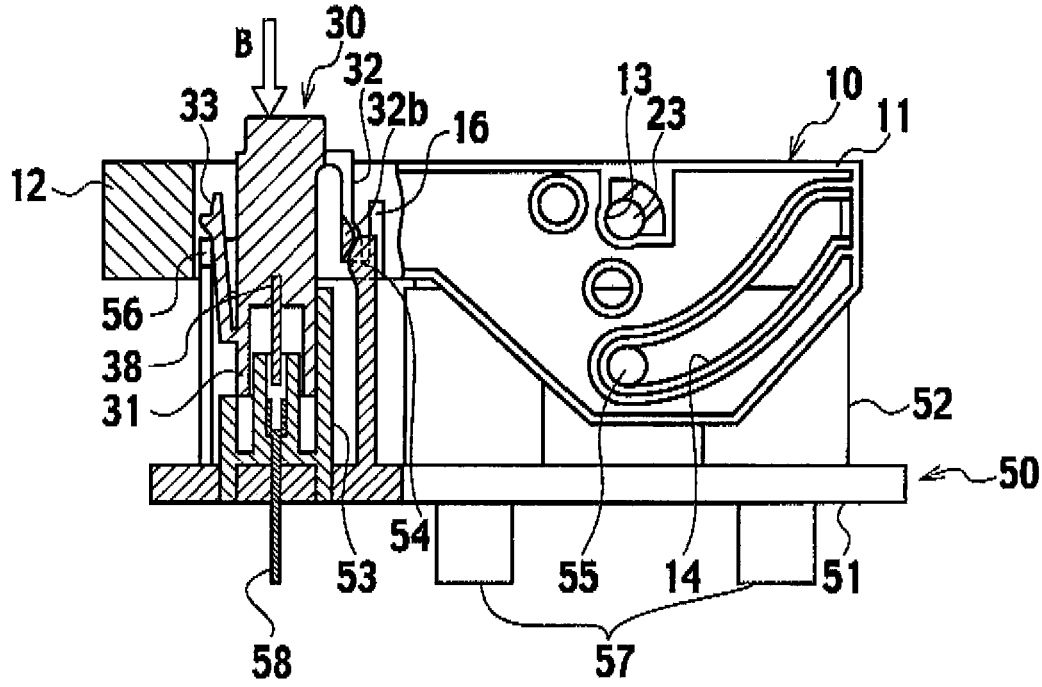
FIG. 5 is a partial broken side view illustrating the connector housings fitted to each other by rotating the lever in the condition of FIG. 4.
Figure 6:
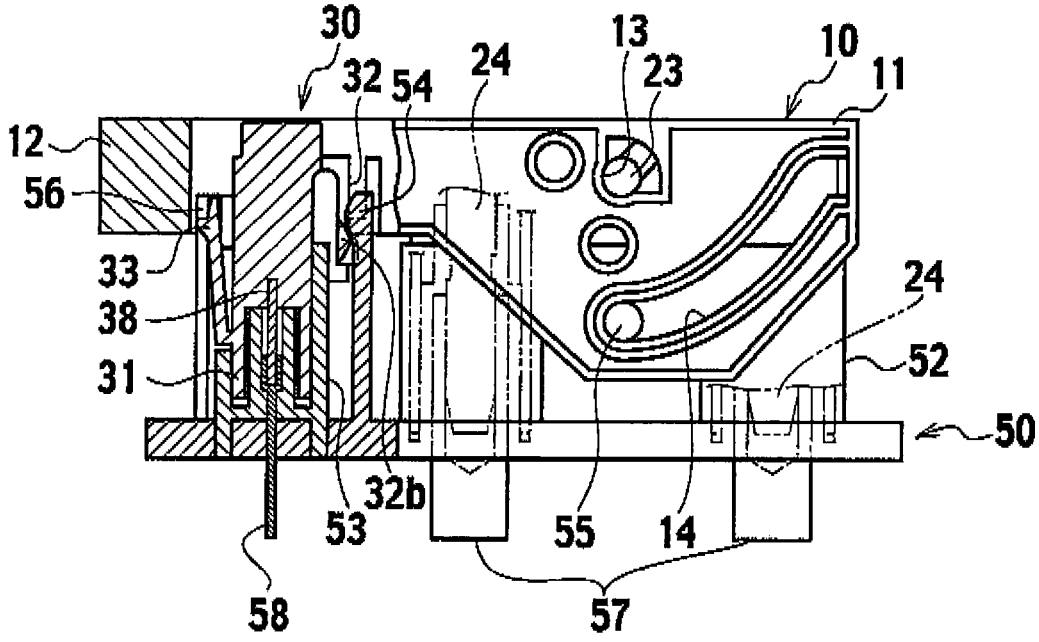
FIG. 6 is a partial broken side view illustrating a fitting-completed condition in which a movable element of a fitting sensing switch is fitted to the fixed side from the condition where the connector housings are fitted to each other.

Next, the lever 10 in this condition is rotated in the direction shown by the arrow A. In accordance with the rotation of the lever 10, the position of the cam groove 14 engaged with the engagement pin 55 become closer to the rotation supporting point (the engagement holes 13 and the rotation pins 23). As a result, the cam action by the cam groove 14 and the engagement pin 55 as shown in FIG. 5 allows the fitting section 21 of the movable-side connector housing 20 to be fitted to the fixed side-main connector housing 51. Then, the movable side power terminal 24 is abutted to the fixed side power terminal 57, thereby turning on the power switch.

When this condition is reached, the lock cancelling arm 54 provided at the fixed-side connector housing 50 is abutted to the lock cancelling section 32*b* of the first lock arm 32 of the movable element 30. This causes the first lock arm 32 to be deflected to the inner side. This cancels the abutment (lock) of the lock section 32*a* of the first lock arm 32 to the stopper 16. When the movable element 30 is pushed in the direction shown by an arrow B, the fitting section 31 of the movable element 30 is fitted to a fitting sensing switch housing 53 of the fixed-side connector housing 50. As a result, the fitting sensing terminals of the movable side 38 and the fixed side 58 have a contact to turn on the fitting sensing switch. When the fitting sensing switch is turned on, a relay provided in the power supply circuit is turned on, thereby providing the power supply circuit in a conduction state. When the movable element 30 is pushed in the manner as described above, the second lock arm 33 of the movable element 30 is engaged with the latch section 56 of the fixed-side connector housing 50. As a result, the movable element 30 is locked to achieve a fitting completed condition.

As described above, the movable element 30 of the fitting sensing switch is provided as the link member connecting the pair of arm plates 11 of the lever 10. This eliminates the need to provide the movable element 30 of the fitting sensing switch with any other alternative spaces. Thus, the lever 10 can have a more compact configuration.

Furthermore, the movable element 30 can be fitted to the fixed side of the fitting sensing switch only when the movable element 30 is slid and the connector housings 20 and 50 are appropriately fitted to each other. This prevents a risk of a wrong operation and the power supply circuit can be provided in a conduction state only when a fixed procedure is completed securely.

Although the above embodiment provides the rotation pins 23 to the connector housing 20 and provides the engagement holes 13 to the lever 10, the rotation pin also may be provided in a protruded manner at the inner face of the arm plate 11 of the lever 10 and the engagement hole to which the rotation pin is fitted also may be provided to the connector housing 20.

What is claimed is:

1. A lever-type connector, comprising:

first and second connector housings fitted to each other;

a lever including a pair of arm plates having rotation supporting points at one ends respectively and a connection bar linking the other ends of the pair of arm plates, which constructed to a substantially U-like shape; and a link member linking the arm plates of the lever; wherein:

the one ends of the pair of arm plates can be attached, in a rotatable manner, at the rotation supporting point thereof to a rotation supporting pivot provided at an outer face of the first connector housing, respectively, by opening the one ends of the pair of arm plates to the outer sides;

an action by a cam mechanism provided between the lever and the second connector housing assists the connector housings to be fitted to each other and to be disengaged from one another by rotating the lever for operation; and after the lever is attached to the first connector housing, the link member is attached between the arm plates at a position closer to the rotation supporting point than to the connection bar.

2. The lever-type connector according to claim 1, wherein:

power terminals constituting a power switch are provided to the connector housings, respectively;

fitting sensing terminals constituting a fitting sensing switch are provided to the lever and the second connector housing, respectively;

the power terminals and the fitting sensing terminals are configured as a lever fitting-type power supply circuit shutoff apparatus in which, the power switch is turned on when the connector housings are correctly fitted to each other, the fitting sensing switch is turned on when the fitting sensing terminal are subsequently abutted to each other, and a power supply circuit is caused to be in a conduction state when the fitting sensing switch is turned on; and the movable element of the fitting sensing switch accommodates therein the fitting sensing terminal and is attached as the link member between the pair of arm plates of the lever.

3. The lever-type connector according to claim 2, wherein:

the movable element of the fitting sensing switch is slidably provided via rails engaged to each other to the lever;

a lock mechanism and a lock cancelling mechanism are provided to the lever and the second connector housing, the lock mechanism and the lock cancelling mechanism allow the movable element to be locked at a fixed position while the lever is rotated from a fitting initial position to a fitting end position, when the lever is rotated and reaches the fitting end position, the lock of the movable element to the fixed position is cancelled and the movable element is allowed to slid and is fitted to the fixed side of the fitting sensing switch provided at the second connector housing; and a fitting sensing switch lock mechanism is provided to the second connector housing and the movable element of the fitting sensing switch to allow, when the movable element is fitted to the fixed side of the fitting sensing switch, the movable element to be locked in this condition.

* * * * *

UNITED STATES PATENT AND TRADEMARK OFFICE

CERTIFICATE OF CORRECTION

PATENT NO. : 7,625,225 B2
APPLICATION NO. : 12/251940
DATED : December 1, 2009
INVENTOR(S) : Shigeo Mori et al.

It is certified that error appears in the above-identified patent and that said Letters Patent is hereby corrected as shown below:

In claim 2, column 8, line 10, "terminal" should read --terminals--.

In claim 3, column 8, line 30, "slid" should read --slide--.

Signed and Sealed this

Twenty-third Day of February, 2010

David J. Kappos

David J. Kappos
*Director of the United States Patent and Trademark Office*